US006575559B2

(12) United States Patent
McElfresh et al.

(10) Patent No.: US 6,575,559 B2
(45) Date of Patent: Jun. 10, 2003

(54) JOINING OF DIFFERENT MATERIALS OF CARRIER FOR FLUID EJECTION DEVICES

(75) Inventors: David K McElfresh, San Diego, CA (US); Mohammad Akhavain, Escondido, CA (US); Joseph E Scheffelin, Poway, CA (US); Gerald V Rapp, Escondido, CA (US); Janis Horvath, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/999,531

(22) Filed: Oct. 31, 2001

(65) Prior Publication Data

US 2003/0081058 A1 May 1, 2003

(51) Int. Cl.[7] ..... B41J 2/15; B41J 2/155; B41J 2/14

(52) U.S. Cl. ..... 347/40; 347/42; 347/49

(58) Field of Search ..... 347/20, 40, 42, 347/43, 49, 57–59, 44; 216/27; 29/25.35

(56) References Cited

U.S. PATENT DOCUMENTS

| | | | |
|---|---|---|---|
| 4,463,359 A | 7/1984 | Ayata et al. | |
| 5,016,023 A | 5/1991 | Chan et al. | |
| 5,079,189 A | 1/1992 | Drake et al. | |
| 5,098,503 A | 3/1992 | Drake | |
| 5,160,945 A | 11/1992 | Drake | |
| 5,469,199 A | 11/1995 | Allen et al. | |
| 5,696,544 A | 12/1997 | Komuro | |
| 5,719,605 A | 2/1998 | Anderson et al. | |
| 5,742,305 A | 4/1998 | Hackleman | |
| 5,755,024 A | 5/1998 | Drake et al. | |
| 5,946,012 A | 8/1999 | Courian et al. | |

OTHER PUBLICATIONS

Allen, R., "Ink Jet Printing with Large Pagewide Arrays: Issues and Challenges", Recent Progress in Ink Jet Technologies II, pp. 114–120.

*Primary Examiner*—John Barlow
*Assistant Examiner*—An H. Do

(57) ABSTRACT

A carrier for a plurality of fluid ejection devices includes a substrate and a substructure. The substrate includes a first material and has a first side adapted to receive the fluid ejection devices and a second side opposite the first side, and the substructure is formed of a second material and joined to the second side of the substrate with a lap joint. The lap joint includes a first portion formed by a portion of one of the substrate and the substructure, a second portion formed by a portion of the other of the substrate and the substructure, and a third material interposed between the first portion and the second portion.

49 Claims, 6 Drawing Sheets

JOINING OF DIFFERENT MATERIALS OF CARRIER FOR FLUID EJECTION DEVICES

THE FIELD OF THE INVENTION

The present invention relates generally to printheads, and more particularly to joining of different materials of a carrier for printhead dies in a printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires that the single carrier perform several functions including fluid and electrical routing as well as printhead die support. More specifically, the single carrier must accommodate communication of ink between the ink supply and each of the printhead dies, accommodate communication of electrical signals between the electronic controller and each of the printhead dies, and provide a stable support for each of the printhead dies. Unfortunately, effectively combining these functions in one unitary structure is difficult.

To effectively combine the functions of fluid and electrical routing and printhead die support, the single carrier may include multiple components each formed of different materials and joined or assembled together to create the single carrier. As such, the various components may have different coefficients of thermal expansion. Thus, joints between the various components must withstand high temperatures and/or temperature variations during operation of the printing system as well as stresses such as normal and/or peeling stresses between the components. In addition, the joints must also compensate for surface variations between the components.

SUMMARY OF THE INVENTION

One aspect of the present invention provides a carrier for a plurality of fluid ejection devices. The carrier includes a substrate and a substructure. The substrate includes a first material and has a first side adapted to receive the fluid ejection devices and a second side opposite the first side, and the substructure is formed of a second material and joined to the second side of the substrate with a lap joint. The lap joint includes a first portion formed by a portion of one of the substrate and the substructure, a second portion formed by a portion of the other of the substrate and the substructure, and a third material interposed between the first portion and the second portion.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
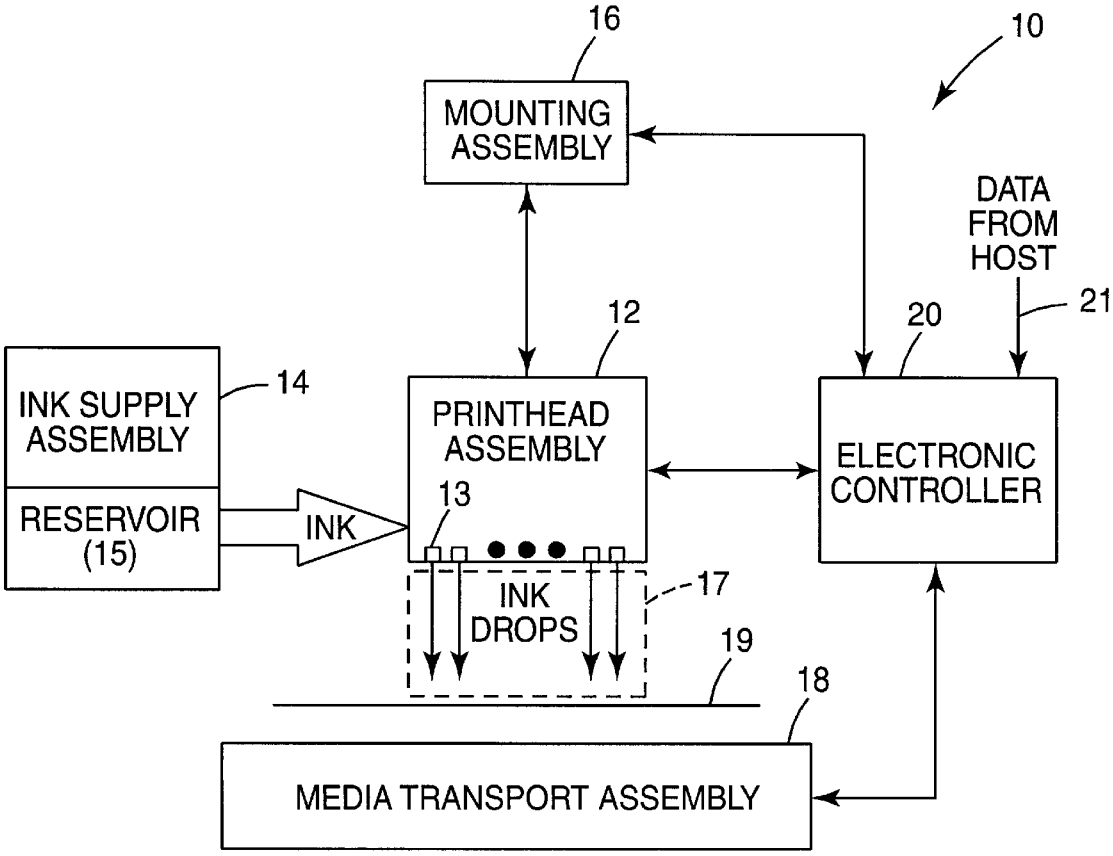
FIG. 1 is a block diagram illustrating one embodiment of A printing system according to an embodiment of the present invention.

FIG. 1 illustrates one embodiment of a printing system 10 according to the present invention. Inkjet printing system 10 includes a printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
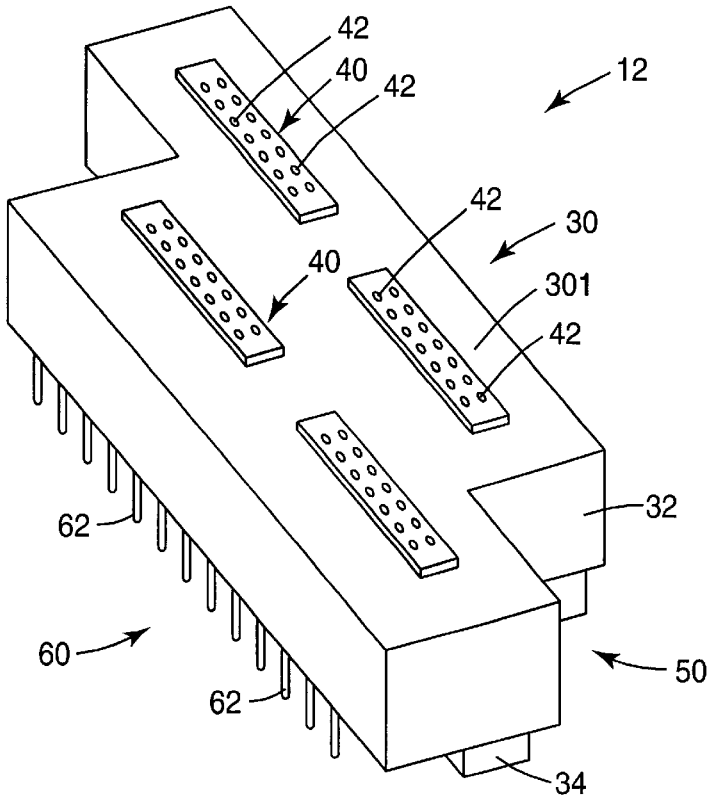
FIG. 2 is a top perspective view of a printhead assembly according to an embodiment of the present invention.
Figure 3:
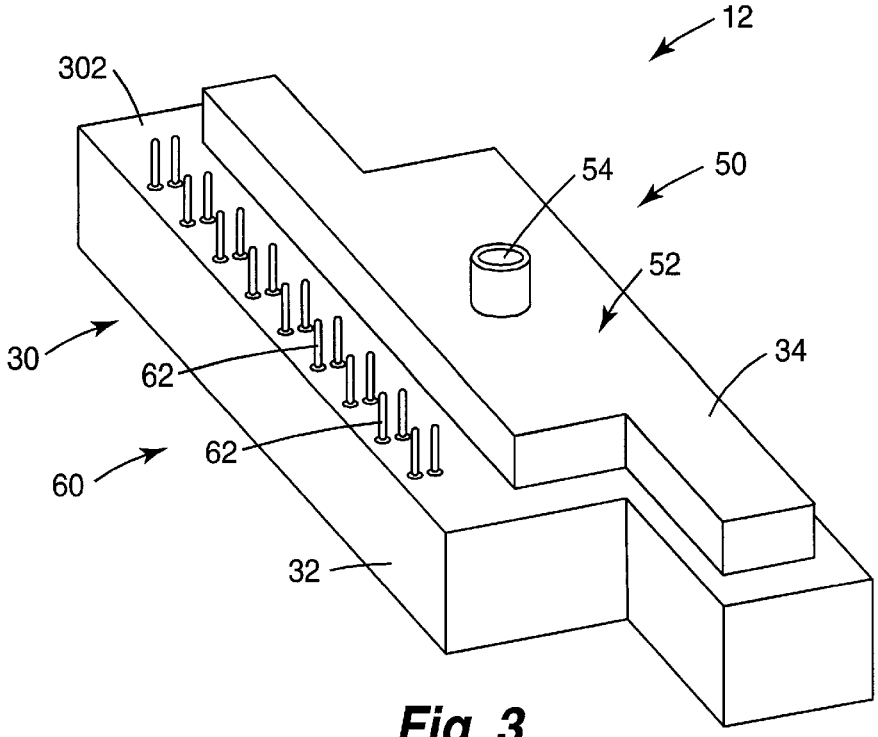
FIG. 3 is a bottom perspective view of the printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposite of and oriented substantially parallel with first face 301. Carrier 30 serves to carry or provide mechanical support for printhead dies 40. In addition, carrier 30 accommodates fluidic communication between printhead dies 40 and ink supply assembly 14 via ink delivery system 50 and accommodates electrical communication between printhead dies 40 and electronic controller 20 via electronic interface system 60.

Printhead dies 40 are mounted on first face 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is formed in carrier 30 and distributes ink through carrier 30 to each printhead die 40. Port 54 communicates with manifold 52 and provides an inlet for ink supplied by ink supply assembly 14.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20. Although electrical contacts 62 are illustrated as being provided on second face 302 of carrier 30, it is within the scope of the present invention for electrical contacts 62 to be provided on other sides of carrier 30.

Figure 4:
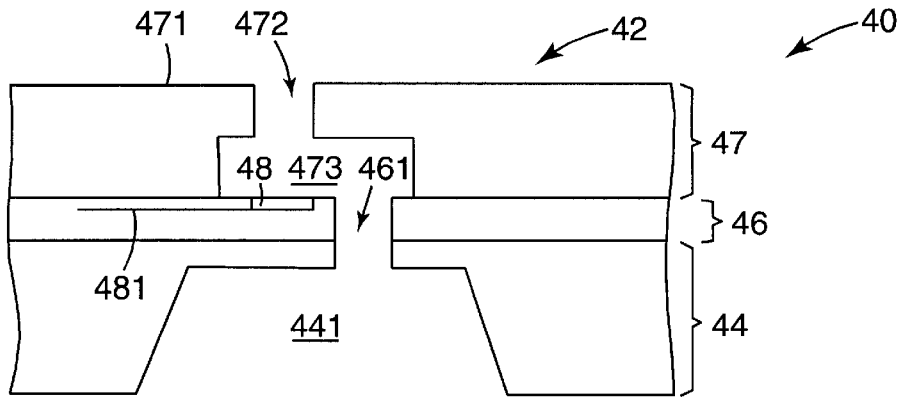
FIG. 4 is a schematic cross-sectional view illustrating portions of a printhead die according to the present invention.

As illustrated in FIGS. 2 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
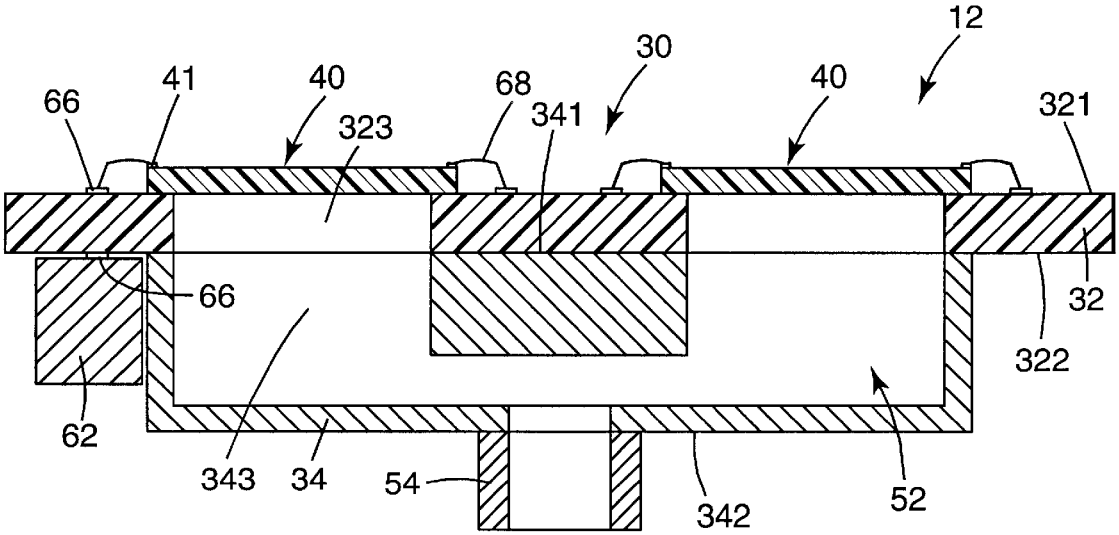
FIG. 5 is a schematic cross-sectional view illustrating one embodiment of an inkjet printhead assembly according to an embodiment of the present invention

Referring to FIGS. 2, 3, and 5, carrier 30 includes a substrate 32 and a substructure 34. Substrate 32 and substructure 34 both provide and/or accommodate mechanical, electrical, and fluidic functions of inkjet printhead assembly 12. More specifically, substrate 32 provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60. Substructure 34 provides mechanical support for substrate 32, accommodates fluidic communication between ink supply assembly 14 and printhead dies 40 via ink delivery system 50, and accommodates electrical connection between printhead dies 40 and electronic controller 20 via electronic interface system 60.

Substrate 32 has a first side 321 and a second side 322 which is opposite first side 321, and substructure 34 has a first side 341 and a second side 342 which is opposite first side 341. In one embodiment, printhead dies 40 are mounted on first side 321 of substrate 32 and substructure 34 is disposed on second side 322 of substrate 32. As such, first side 341 of substructure 34 contacts and, as described below, is joined to second side 322 of substrate 32.

For transferring ink between ink supply assembly 14 and printhead dies 40, substrate 32 and substructure 34 each have at least one ink passage 323 and 343, respectively, formed therein. Ink passage 323 extends through substrate 32 and provides a through-channel or through-opening for delivery of ink to printhead dies 40 and, more specifically, ink feed slot 441 of substrate 44 (FIG. 4). Ink passage 343 extends through substructure 34 and provides a through-channel or through-opening for delivery of ink to ink passage 323 of substrate 32. As such, ink passages 323 and 343 form a portion of ink delivery system 50. Although only one ink passage 323 is shown for a given printhead die 40, there may be additional ink passages to the same printhead die, for example, to provide ink of respective differing colors.

Figure 6:
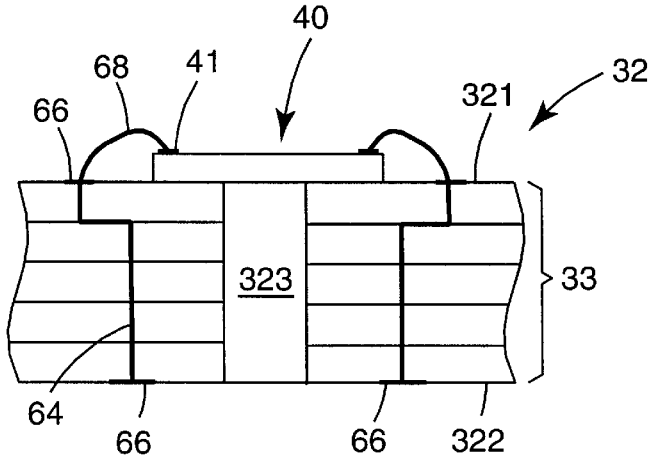
FIG. 6 is a schematic cross-sectional view illustrating one embodiment of a portion of a substrate according to an embodiment of the present invention.

For transferring electrical signals between electronic controller 20 and printhead dies 40, electronic interface system 60 includes a plurality of conductive paths 64 extending through substrate 32, as illustrated in FIG. 6. More specifically, substrate 32 includes conductive paths 64 which pass through and terminate at exposed surfaces of substrate 32. In one embodiment, conductive paths 64 include electrical contact pads 66 at terminal ends thereof which form, for example, I/O bond pads on substrate 32. Conductive paths 64, therefore, terminate at and provide electrical coupling between electrical contact pads 66.

Electrical contact pads 66 provide points for electrical connection to substrate 32 and, more specifically, conductive paths 64. Electrical connection is established, for example, via electrical connectors or contacts 62, such as I/O pins or spring fingers, wire bonds, electrical nodes, and/or other suitable electrical connectors. In one embodiment, printhead dies 40 include electrical contacts 41 which form I/O bond pads. As such, electronic interface system 60 includes electrical connectors, for example, wire bond leads 68, which electrically couple electrical contact pads 66 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data. Print data includes, for example, nozzle data containing pixel information such as bitmap print data. Non-print data includes, for example, command/status (CS) data, clock data, and/or synchronization data. Status data of CS data includes, for example, printhead temperature or position, print resolution, and/or error notification.

In one embodiment, as illustrated in FIG. 6, substrate 32 includes a plurality of layers 33 each formed of a ceramic material. As such, substrate 32 includes circuit patterns which pierce layers 33 to form conductive paths 64. In one fabrication methodology, circuit patterns are formed in layers of unfired tape (referred to as green sheet layers) using a screen printing process. The green sheet layers are made of ceramic particles in a polymer binder. Alumina may be used for the particles, although other oxides or various glass/ceramic blends may be used. Each green sheet layer receives conductor lines and other metallization patterns as needed to form conductive paths 64. Such lines and patterns are formed with a refractory metal, such as tungsten, by screen printing on the corresponding green sheet layer. Thereafter, the green sheet layers are fired. Thus, conductive and non-conductive or insulative layers are formed in substrate 32. While substrate 32 is illustrated as including layers 33, it is, however, within the scope of the present invention for substrate 32 to be formed of a solid pressed ceramic material. As such, conductive paths are formed, for example, as thin-film metallized layers on the pressed ceramic material.

While conductive paths 64 are illustrated as terminating at first side 321 and second side 322 of substrate 32, it is, however, within the scope of the present invention for conductive paths 64 to terminate at other sides of substrate 32. In addition, one or more conductive paths 64 may branch from and/or lead to one or more other conductive paths 64. Furthermore, one or more conductive paths 64 may begin and/or end within substrate 32. Conductive paths 64 may be formed as described, for example, in U.S. patent application Ser. No. 09/648,565, entitled "Wide-Array Inkjet Printhead Assembly with Internal Electrical Routing System" assigned to the assignee of the present invention and incorporated herein by reference.

In one embodiment, substructure 34 is formed of a non-ceramic material such as plastic. Substructure 34 is formed, for example, of a high performance plastic such as fiber reinforced noryl or polyphenylene sulfide (PPS). It is, however, within the scope of the present invention for substructure 34 to be formed of silicon, stainless steel, or other suitable material or combination of materials. Preferably, substructure 34 is chemically compatible with liquid ink so as to accommodate fluidic routing.

It is to be understood that FIGS. 5 and 6 are simplified schematic illustrations of carrier 30, including substrate 32 and substructure 34. The illustrative routing of ink passages 323 and 343 through substrate 32 and substructure 34, respectively, and conductive paths 64 through substrate 32, for example, has been simplified for clarity of the invention. Although various features of carrier 30, such as ink passages 323 and 343 and conductive paths 64, are schematically illustrated as being straight, it is understood that design constraints could make the actual geometry more complicated for a commercial embodiment of inkjet printhead assembly 12. Ink passages 323 and 343, for example, may have more complicated geometries to allow multiple colorants of ink to be channeled through carrier 30. In addition, conductive paths 64 may have more complicated routing geometries through substrate 32 to avoid contact with ink passages 323 and to allow for electrical connector geometries other than the illustrated I/O pins. It is understood that such alternatives are within the scope of the present invention.

Figure 7:
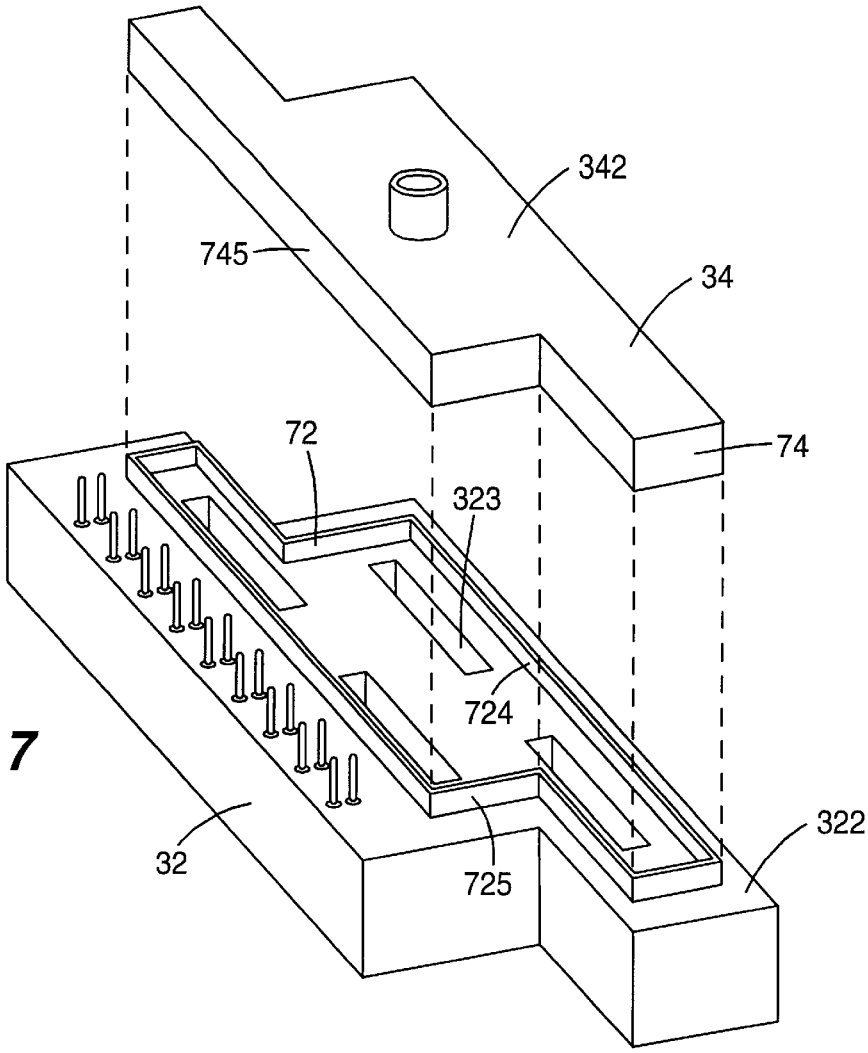
FIG. 7 is an exploded bottom perspective view of the printhead assembly of FIG. 2 illustrating one embodiment of joining a substrate and a substructure according to an embodiment of the present invention.
Figure 8:
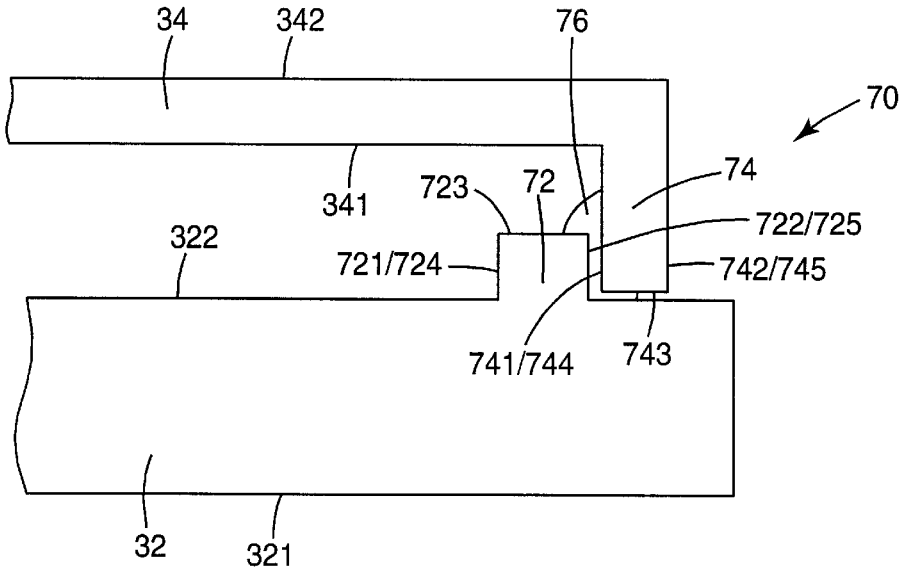
FIG. 8 is a schematic cross-sectional view illustrating one embodiment of a lap joint between the substrate and the substructure of FIG. 7 according to an embodiment of the present invention.

Referring to FIGS. 7 and 8, substrate 32 and substructure 34 are joined by a lap joint 70. In one embodiment, lap joint 70 includes a protrusion 72 formed by a portion of substrate 32 and a protrusion 74 formed by a portion of substructure 34. Protrusion 72 protrudes from second side 322 of substrate 32 and protrusion 74 protrudes from first side 341 of substructure 34. As such, protrusion 72 and protrusion 74 are mated such that protrusion 72 overlaps protrusion 74 to form lap joint 70 between substrate 32 and substructure 34.

Protrusion 72 includes side surfaces 721 and 722 and an end surface 723. Preferably, side surfaces 721 and 722 are oriented substantially parallel to each other and end surface 723 is oriented substantially perpendicular to side surfaces 721 and 722. Protrusion 74 includes side surfaces 741 and 742 and an end surface 743. Preferably, side surfaces 741 and 742 are oriented substantially parallel to each other and end surface 743 is oriented substantially perpendicular to side surfaces 741 and 742.

In one embodiment, protrusion 72 protrudes from second side 322 of substrate 32 so as to form a continuous segment on second side 322 and protrusion 74 protrudes from first side 341 of substructure 34 so as to form a continuous segment on first side 341. As such, protrusion 72 includes an inner perimeter 724 formed by side surface 721 and an outer perimeter 725 formed by side surface 722 and protrusion 74 includes an inner perimeter 744 formed by side surface 741 and an outer perimeter 745 formed by side surface 742. While protrusion 72 of substrate 32 is illustrated as a continuous segment, it is, however, within the scope of the present invention for protrusion 72 to be formed of a plurality of spaced segments protruding from second side 322 of substrate 32.

In one embodiment, lap joint 70 includes an adhesive 76 interposed between protrusion 72 and protrusion 74. As such, substrate 32 and substructure 34 are joined by adhesive 76. More specifically, side surface 741 of protrusion 74 is joined to side surface 722 of protrusion 72 and end surface 743 of protrusion 74 is joined to a surface of second side 322 of substrate 32. Thus, inner perimeter 724 of protrusion 72 is positioned within outer perimeter 745 of protrusion 74.

Figure 9:
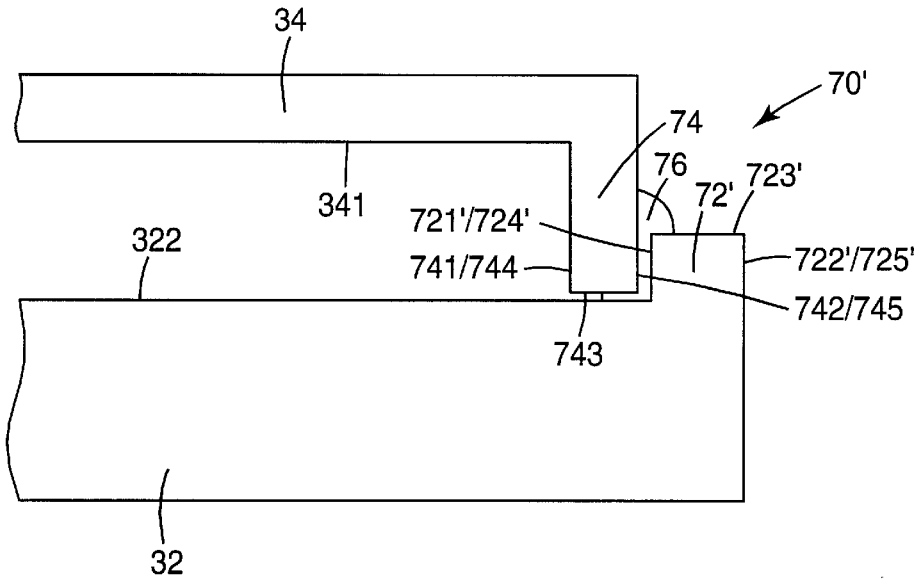
FIG. 9 is a schematic cross-sectional view similar to FIG. 8 illustrating another embodiment of a lap joint between the substrate and the substructure of FIG. 7 according to an embodiment of the present invention.

FIG. 9 illustrates another embodiment of lap joint 70. Lap joint 70' includes a protrusion 72' formed by a portion of substrate 32 and protrusion 74 formed by a portion of substructure 34. Similar to protrusion 72, protrusion 72' protrudes from second side 322 of substrate 32. As such, protrusion 72' and protrusion 74 are mated such that protrusion 72' overlaps protrusion 74 to form lap joint 70' between substrate 32 and substructure 34.

Similar to protrusion 72, protrusion 72' includes side surfaces 721' and 722' and an end surface 723'. In addition, protrusion 72' includes an inner perimeter 724' formed by side surface 721' and an outer perimeter 725' formed by side surface 722'. Substrate 32 and substructure 34 are joined by adhesive 76 such that side surface 742 of protrusion 74 is joined to side surface 721' of protrusion 72' and end surface 743 of protrusion 74 is joined to a surface of second side 322 of substrate 32. As such, inner perimeter 744 of protrusion 74 is positioned within outer perimeter 725' of protrusion 72'.

Figure 10:
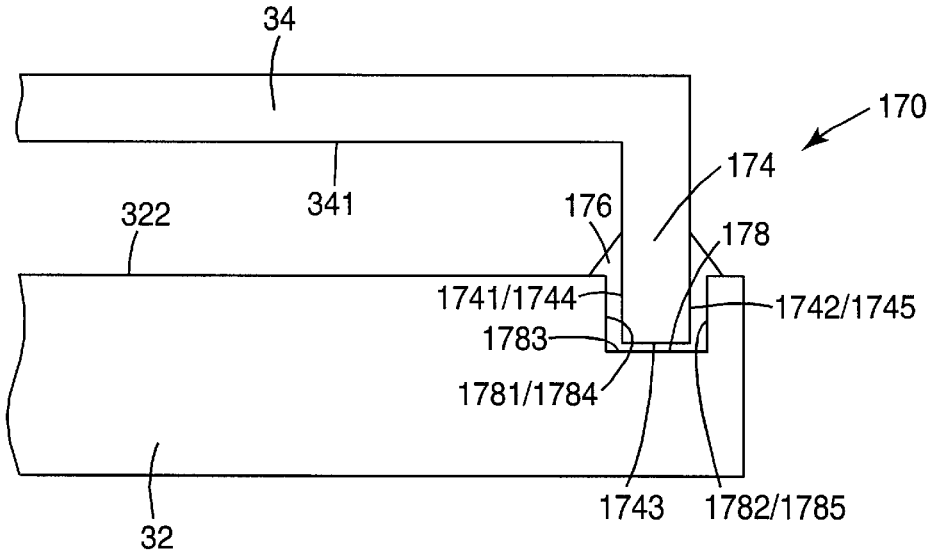
FIG. 10 is a schematic cross-sectional view illustrating another embodiment of a lap joint between a substrate and a substructure according to an embodiment of the present invention.

FIG. 10 illustrates another embodiment of lap joint 70. Lap joint 170 includes a groove 178 formed in substrate 32 and a protrusion 174 formed by a portion of substructure 34. Groove 178 is formed in second side 322 of substrate 32 and protrusion 174 protrudes from first side 341 of substructure 34. As such, protrusion 174 and groove 178 are mated such that protrusion 174 fits within groove 178 to form lap joint 170 between substrate 32 and substructure 34.

Groove 178 includes side surfaces 1781 and 1782 and a bottom surface 1783. Preferably, side surfaces 1781 and 1782 are oriented substantially parallel to each other and bottom surface 1783 is oriented substantially perpendicular to side surfaces 1781 and 1782. Similar to protrusion 74, as described above, protrusion 174 includes side surfaces 1741 and 1742 and an end surface 1743. As such, groove 178 includes an inner perimeter 1784 formed by side surface 1781 and an outer perimeter 1785 formed by side surface 1782 and protrusion 174 includes an inner perimeter 1744 formed by side surface 1741 and an outer perimeter 1745 formed by side surface 1742. While groove 178 and protrusion 174 are illustrated as having square cross-sectional profiles, it is, however, within the scope of the present invention for groove 178 and/or protrusion 174 to have other cross-sectional profiles such as a V-shape or semi-circular profile.

In one embodiment, groove 178 is formed in second side 322 of substrate 32 so as to form a continuous groove in second side 322 and protrusion 174 protrudes from first side 341 of substructure 34 so as to form a continuous segment on first side 341. It is, however, within the scope of the present invention for groove 178 to include a plurality of spaced grooves formed in second side 322 of substrate 32 and for protrusion 174 to be formed of a plurality of segments protruding from first side 341 of substructure 34 and coinciding with the spaced grooves.

In one embodiment, lap joint 170 includes an adhesive 176 interposed between protrusion 174 and groove 178. As such, substrate 32 and substructure 34 are joined by adhesive 176. More specifically, side surface 1741 of protrusion 174 is joined to side surface 1781 of groove 178, side surface 1742 of protrusion 174 is joined to side surface 1782 of groove 178, and end surface 1743 of protrusion 174 is joined to bottom surface 1783 of groove 178. Thus, inner perimeter 1744 of protrusion 174 is positioned within outer perimeter 1785 of groove 178 and inner perimeter 1784 of groove 178 is positioned within outer perimeter 1745 of protrusion 174.

Figure 11:
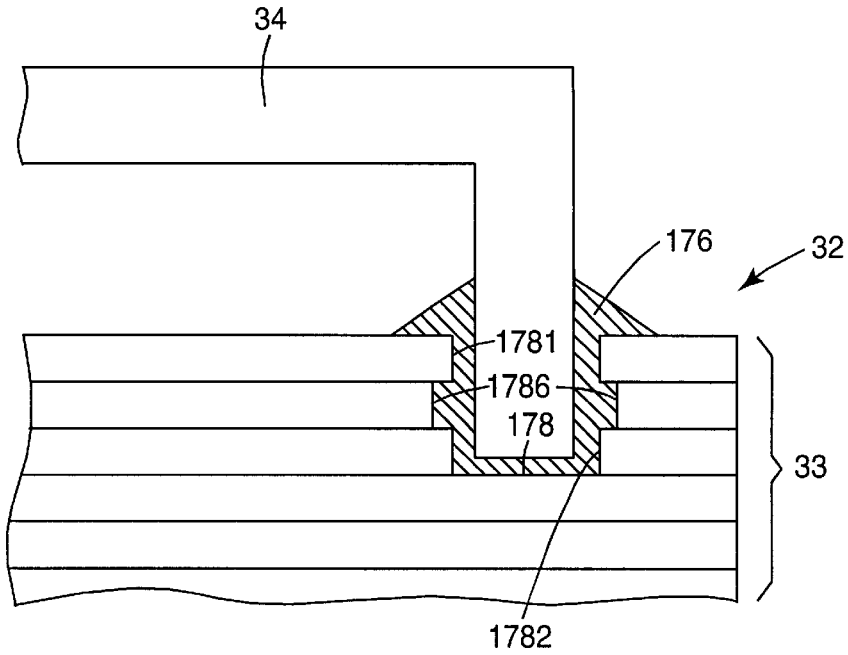
FIG. 11 is a schematic cross-sectional view illustrating another embodiment of the lap joint of FIG. 10.

In one embodiment, as illustrated in FIG. 11, side surfaces 1781 and 1782 of groove 178 include cavities or voids 1786. Adhesive 176 penetrates and conforms to voids 1786 so as to form anchor points in side surfaces 1781 and 1782 of groove 178. As such, adhesive 176 forms an interlocking joint between substrate 32 and substructure 34. Thus, in addition to forming a chemical bond between substrate 32 and substructure 34, adhesive 176 forms a mechanical bond between substrate 32 and substructure 34 by conforming to side surfaces 1781 and 1782.

When substrate 32 is formed of layers 33, voids 1786 are formed in groove 178 by, for example, forming holes of differing sizes in layers 33 such that when layers 33 are stacked, side surfaces 1781 and 1782 are formed with voids 1786. While side surfaces 1781 and 1782 and, therefore, groove 178, are illustrated as being symmetrical, it is, however, within the scope of the present invention for side surfaces 1781 and 1782 to be non-symmetrical. In addition, voids 1786 may be formed in only one side surface of groove 178. Furthermore, it is understood that voids 1786 may formed in other manners and may have various shapes and/or sizes.

Figure 12:
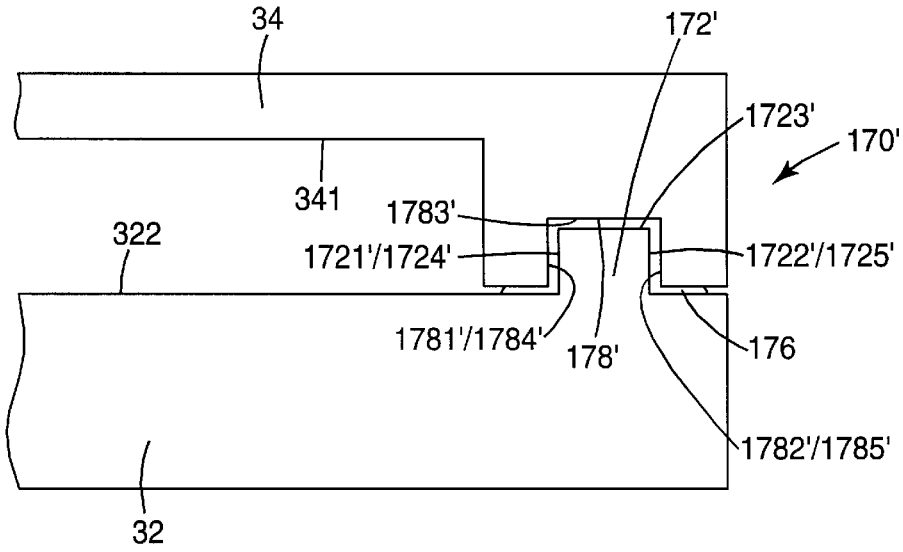
FIG. 12 is a schematic cross-sectional view illustrating another embodiment of a lap joint between a substrate and a substructure according to an embodiment of the present invention.

FIG. 12 illustrates another embodiment of lap joint 170. Lap joint 170' includes a protrusion 172' formed by a portion of substrate 32 and a groove 178' formed in substructure 34. Protrusion 172', similar to protrusion 72, protrudes from second side 322 of substrate 32 and groove 178' is formed in first side 341 of substructure 34. As such, protrusion 172' and groove 178' are mated such that protrusion 172' fits within groove 178' to form lap joint 170' between substrate 32 and substructure 34.

Similar to protrusion 72, as described above, protrusion 172' includes side surfaces 1721' and 1722' and an end surface 1723' and, similar to groove 178, as described above, groove 178' includes side surfaces 1781' and 1782' and a bottom surface 1783'. As such, protrusion 172' includes an inner perimeter 1724' formed by side surface 1721' and an outer perimeter 1725' formed by side surface 1722' and groove 178' includes an inner perimeter 1784' formed by side surface 1781' and an outer perimeter 1785' formed by side surface 1782'.

Substrate 32 and substructure 34 are joined by adhesive 176 such that side surface 1721' of protrusion 172' is joined to side surface 1781' of groove 178', side surface 1722' of protrusion 172' is joined to side surface 1782' of groove 178', and end surface 1723' of protrusion 172' is joined to bottom surface 1783' of groove 178'. Thus, inner perimeter 1724' of protrusion 172' is positioned within outer perimeter 1785' of groove 178' and inner perimeter 1784' of groove 178' is positioned within outer perimeter 1725' of protrusion 172'.

While lap joints 170 and 170' are illustrated as including adhesive 176, it is, however, within the scope of the present invention for lap joint 170 and/or lap joint 170' to be formed by press-fit of protrusion 174 and groove 178 and/or protrusion 172' and groove 178', respectively. As such, lap joint 170 and/or lap joint 170' include compressive forces between substrate 32 and substructure 34, as described below, when substrate 32 and substructure 34 are joined.

Substrate 32 and substructure 34 each have a coefficient of thermal expansion. In one embodiment, as described above, substrate 32 is formed of a ceramic material and substructure 34 is formed of a non-ceramic material such as plastic. As such, the coefficient of thermal expansion of substructure 34 is greater than the coefficient of thermal expansion of substrate 32. Thus, an extent of expansion and/or contraction of substructure 34 is greater than that of substrate 32.

In one embodiment, adhesive 76 (including adhesive 176) is a heat cured or thermal adhesive. As such, adhesive 76 cures or sets at a predetermined temperature. An example of adhesives 76 and 176 includes Emerson & Cuming's 3250 adhesive. In addition, inkjet printhead assembly 12 operates at a predetermined temperature commonly referred to as a service temperature. As such, components of inkjet printhead assembly 12, including substrate 32 and substructure 34, are subject to the service temperature during operation.

Preferably, lap joints 70 and 170 (including lap joints 70' and 170', respectively) are under compression. More specifically, lap joints 70 and 170 are configured or arranged to develop compressive forces between substrate 32 and substructure 34 when substrate 32 and substructure 34 are joined. For example, when the predetermined temperature at which inkjet printhead assembly 12 operates is less than the predetermined temperature at which adhesive 76 sets, an inner perimeter of a portion of lap joints 70 and 170 formed by substrate 32 is positioned within an outer perimeter of a portion of lap joints 70 and 170 formed by substructure 34. Such arrangement is described above with respect to lap joints 70, 170, and 170' and illustrated in FIGS. 8, 10, and 12. As such, contraction of substructure 34 relative to substrate 32 creates compressive forces in lap joints 70, 170, and 170'. However, when the predetermined temperature at which inkjet printhead assembly 12 operates is greater than the predetermined temperature at which adhesive 76 sets, an inner perimeter of a portion of lap joints 70 and 170 formed by substructure 34 is positioned within an outer perimeter of a portion of lap joints 70 and 170 formed by substrate 32. Such arrangement is described above with respect to lap joints 70', 170, and 170' and illustrated in FIGS. 9, 10, and 12. As such, expansion of substructure 34 relative to substrate 32 creates compressive forces in lap joints 70', 170, and 170'.

By joining substrate 32 and substructure 34 with lap joints 70 and 170 (including lap joints 70' and 170'), a secure joint between components of carrier 30 is formed. More specifically, with lap joints 70 and 170, multiple surfaces of substrate 32 and substructure 34 are joined to each other. For example, with lap joint 70, side surface 741 of protrusion 74 is joined to side surface 722 of protrusion 72 and end surface 743 of protrusion 74 is joined to a surface of second side 322 of substrate 32. As such, lap joints 70 and 170 can accommodate or compensate for surface variations between substrate 32 and substructure 34. While lap joints 70 and 170 (including lap joints 70' and 170') are illustrated as being formed with overlapping protrusions and/or mating protrusions and grooves, it is understood that other configurations of complimentary portions of substrate 32 and substructure 34 may form lap joints 70 and 170.

As substrate 32 and substructure 34 are formed of different materials including, more specifically, a ceramic material and a non-ceramic material, respectively, lap joints 70 and 170 (including lap joints 70' and 170') accommodate a difference of thermal expansion of substrate 32 and substructure 34. More specifically, based on the difference of thermal expansion of substrate 32 and substructure 34, lap joints 70 and 170 are configured or arranged to develop compressive forces between substrate 32 and substructure 34 when substrate 32 and substructure 34 are joined. As such, contraction or expansion of substructure 34 relative to substrate 32 creates compressive forces in the respective lap joints, as described above. Thus, lap joints 70 and 170 accommodate a curing or setting temperature of adhesives 76 and 176, respectively, as well as temperature variations of substrate 32 and/or substructure 34 during operation of inkjet printhead assembly 12.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a carrier including a substrate including a first material and a substructure formed of a second material, wherein the substrate and the substructure are joined by a lap joint; and a plurality of printhead dies each mounted on the substrate of the carrier, wherein the lap joint includes a first portion formed by a portion of one of the substrate and the substructure, a second portion formed by a portion of the other of the substrate and the substructure, and a third material interposed between the first portion and the second portion.

2. The inkjet printhead assembly of claim 1, wherein the first material includes a ceramic material and the second material includes one of plastic and metal.

3. The inkjet printhead assembly of claim 2, wherein the first material includes a plurality of layers of the ceramic material.

4. The inkjet printhead assembly of claim 1, wherein the lap joint is under compression.

5. The inkjet printhead assembly of claim 1, wherein the first portion of the lap joint includes a first protrusion and the second portion of the lap joint includes a second protrusion, wherein the first protrusion and the second protrusion overlap.

6. The inkjet printhead assembly of claim 1, wherein the first portion of the lap joint includes a groove and the second portion of the lap joint includes a protrusion, wherein the protrusion fits within the groove.

7. The inkjet printhead assembly of claim 1, wherein a first surface of the first portion of the lap joint is joined to a first surface of the second portion of the lap joint and a second surface of the first portion of the lap joint is joined to a second surface of the second portion of the lap joint.

8. The inkjet printhead assembly of claim 7, wherein a third surface of the first portion of the lap joint is joined to a third surface of the second portion of the lap joint.

9. The inkjet printhead assembly of claim 7, wherein one of the first surface of the first portion of the lap joint and the first surface of the second portion of the lap joint has a void formed therein, wherein the third material penetrates the void.

10. The inkjet printhead assembly of claim 1, wherein the third material includes an adhesive.

11. The inkjet printhead assembly of claim 10, wherein the adhesive is adapted to set at a first temperature and the inkjet printhead assembly is adapted to operate at a second temperature, and wherein the first portion of the lap joint is formed by a portion of the substrate and the second portion of the lap joint is formed by a portion of the substructure.

12. The inkjet printhead assembly of claim 11, wherein the second temperature is less than the first temperature, and wherein an inner perimeter of the first portion of the lap joint is positioned within an outer perimeter of the second portion of the lap joint.

13. The inkjet printhead assembly of claim 11 wherein the second temperature is greater than the first temperature, and wherein an inner perimeter of the second portion of the lap joint is positioned within an outer perimeter of the first portion of the lap joint.

14. An inkjet printhead assembly, comprising:

a carrier including a substrate including a first material and a substructure formed of a second material, wherein the substrate and the substructure are joined by a lap joint; and a plurality of printhead dies each mounted on the substrate of the carrier, wherein the substrate has a plurality of conductive paths extending therethrough and a plurality of ink passages defined therein and the substructure has at least one ink passage extending therethrough, wherein at least one of the ink passages of the substrate communicates with the at least one ink passage of the substructure, and wherein each of the printhead dies are electrically coupled to at least one of the conductive paths of the substrate and communicate with at least one of the ink passages of the substrate.

15. The inkjet printhead assembly of claim 14, wherein the first material includes a plurality of layers of a ceramic material and the second material includes one of plastic and metal.

16. The inkjet printhead assembly of claim 14, wherein the lap joint includes a third material interposed between a portion of the substrate and a portion of the substructure.

17. The inkjet printhead assembly of claim 14, wherein the substrate has a first coefficient of thermal expansion and the substructure has a second coefficient of thermal expansion greater than the first coefficient of thermal expansion, and wherein the lap joint is under compression.

18. A method of forming an inkjet printhead assembly, the method comprising:

providing a substrate including a first material and having a first side and a second side opposite the first side;

mounting a plurality of printhead dies on the first side of the substrate; and joining a substructure formed of a second material to the second side of the substrate with a lap joint, including joining a first portion of the lap joint formed by a portion of one of the substrate and the substructure to a second portion of the lap joint formed by a portion of the other of the substrate and the substructure, and interposing a third material between the first portion of the lap joint and the second portion of the lap joint.

19. The method of claim 18, wherein the first material includes a ceramic material and the second material includes one of plastic and metal.

20. The method of claim 19, wherein the first material includes a plurality of layers of the ceramic material.

21. The method of claim 18, wherein joining the substructure to the substrate with the lap joint includes subjecting the lap joint to compression.

22. The method of claim 18, wherein joining the first portion of the lap joint to the second portion of the lap joint includes overlapping a first protrusion of the portion of the one of the substrate and the substructure and a second protrusion of the portion of the other of the substrate and the substructure.

23. The method of claim 18, wherein joining the first portion of the lap joint to the second portion of the lap joint includes fitting a protrusion of the portion of the one of the substrate and the substructure into a groove of the portion of the other of the substrate and the substructure.

24. The method of claim 18, wherein joining the first portion of the lap joint to the second portion of the lap joint includes joining a first surface of the first portion to a first surface of the second portion and joining a second surface of the first portion to a second surface of the second portion.

25. The method of claim 24, wherein joining the first portion of the lap joint to the second portion of the lap joint further includes joining a third surface of the first portion to a third surface of the second portion.

26. The method of claim 24, wherein interposing the third material between the first portion of the lap joint and the second portion of the lap joint includes penetrating a void formed in one of the first surface of the first portion and the first surface of the second portion.

27. The method of claim 18, wherein interposing the third material between the first portion of the lap joint and the second portion of the lap joint includes interposing an adhesive between the first portion and the second portion.

28. The method of claim 18, wherein the first portion of the lap joint is formed by a portion of the substrate and the second portion of the lap joint is formed by a portion of the substructure, wherein joining the first portion of the lap joint to the second portion of the lap joint includes positioning an inner perimeter of the first portion of the lap joint within an outer perimeter of the second portion of the lap joint.

29. The method of claim 18, wherein the first portion of the lap joint is formed by a portion of the substrate and the second portion of the lap joint is formed by a portion of the substructure, wherein joining the first portion of the lap joint to the second portion of the lap joint includes positioning an inner perimeter of the second portion of the lap joint within an outer perimeter of the first portion of the lap joint.

30. A method of forming an inkjet printhead assembly, the method comprising:

providing a substrate including a first material and having a first side and a second side opposite the first side, the substrate having a plurality of conductive paths extending therethrough and a plurality of ink passages defined therein;

mounting a plurality of printhead dies on the first side of the substrate; and joining a substructure formed of a second material to the second side of the substrate with a lap joint, the substructure having at least one ink passage extending therethrough, wherein mounting the printhead dies on the substrate includes electrically coupling each of the printhead dies to at least one of the conductive paths and communicating each of the printhead dies with at least one of the ink passages of the substrate, and wherein joining the substructure to the substrate includes communicating at least one of the ink passages of the substrate with the at least one ink passage of the substructure.

31. The method of claim 30, wherein the first material includes a plurality of layers of a ceramic material and the second material includes one of plastic and metal.

32. The method of claim 30, wherein joining the substructure to the substrate with the lap joint includes interposing a third material between a portion of the substrate and a portion of the substructure.

33. The method of claim 30, wherein the substrate has a first coefficient of thermal expansion and the substructure has a second coefficient of thermal expansion greater than the first coefficient of thermal expansion, and wherein joining the substructure to the substrate with the lap joint includes subjecting the lap joint to compression.

34. A carrier for a plurality of fluid ejection devices, the carrier comprising:

a substrate including a first material and having a first side adapted to receive the fluid ejection devices and a second side opposite the first side; and a substructure formed of a second material and joined to the second side of the substrate with a lap joint, the lap joint including a first portion formed by a portion of one of the substrate and the substructure, a second portion formed by a portion of the other of the substrate and the substructure, and a third material interposed between the first portion and the second portion.

35. The carrier of claim 34, wherein the first material includes a ceramic material and the second material includes one of plastic and metal.

36. The carrier of claim 34, wherein the lap joint is under compression.

37. The carrier of claim 34, wherein the first portion of the lap joint includes a first protrusion and the second portion of the lap joint includes a second protrusion, wherein the first protrusion and the second protrusion overlap.

38. The carrier of claim 34, wherein the first portion of the lap joint includes a groove and the second portion of the lap joint includes a protrusion, wherein the protrusion fits within the groove.

39. The carrier of claim 34, wherein a first surface of the first portion of the lap joint is joined to a first surface of the second portion of the lap joint and a second surface of the first portion of the lap joint is joined to a second surface of the second portion of the lap joint.

40. The carrier of claim 39, wherein a third surface of the first portion of the lap joint is joined to a third surface of the second portion of the lap joint.

41. The carrier of claim 39, wherein one of the first surface of the fist portion of the lap joint and the first surface of the second portion of the lap joint has a void formed therein, wherein the third material penetrates the void.

42. The carrier of claim 34, wherein the first portion of the lap joint is formed by a portion of the substrate and the second portion of the lap joint is formed by a portion of the substructure, wherein the substrate has a first coefficient of thermal expansion and the substructure has a second coefficient of thermal expansion greater than the first coefficient of thermal expansion.

43. The carrier of claim 42, wherein an inner perimeter of the first portion of the lap joint is positioned within an outer perimeter of the second portion of the lap joint.

44. The carrier of claim 42, wherein an inner perimeter of the second portion of the lap joint is positioned within an outer perimeter of the first portion of the lap joint.

45. The carrier of claim 34, wherein the third material includes an adhesive.

46. A carrier for a plurality of fluid ejection devices, the carrier comprising:

a substrate including a first material and having a first side adapted Lo receive the fluid ejection devices and a second side opposite the first side, the substrate having a plurality of conductive paths extending therethrough and a plurality of fluid passages defined therein; and a substructure formed of a second material and joined to the second side of the substrate with a lap joint, the substructure having at least one fluid passage extending therethrough, wherein at least one of the fluid passages of the substrate communicates with the at least one fluid passage of the substructure.

47. The carrier of claim 46, wherein the first material includes a ceramic material and the second material includes one of plastic and metal.

48. The carrier of claim 46, wherein the lap joint includes a third material interposed between a portion of the substrate and a portion of the substructure.

49. The carrier of claim 46, wherein the substrate has a first coefficient of thermal expansion and the substructure has a second coefficient of thermal expansion greater than the first coefficient of thermal expansion, and wherein the lap joint is under compression.

* * * * *